US010765923B2

(12) United States Patent
Stites et al.

(10) Patent No.: US 10,765,923 B2
(45) **Date of Patent: *Sep. 8, 2020**

(54) GOLF CLUB HEADS

(71) Applicant: Karsten Manufacturing Corporation, Phoenix, AZ (US)

(72) Inventors: John T. Stites, Weatherford, TX (US); David N. Franklin, Grandbury, TX (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/510,716

(22) Filed: Jul. 12, 2019

(65) Prior Publication Data

US 2019/0336836 A1 Nov. 7, 2019

Related U.S. Application Data

(63) Continuation of application No. 16/029,415, filed on Jul. 6, 2018, now Pat. No. 10,369,434, which is a (Continued)

(51) Int. Cl.

| | |
|---|---|
| ***A63B 53/04*** | (2015.01) |
| ***A63B 60/00*** | (2015.01) |
| ***A63B 60/54*** | (2015.01) |

(52) U.S. Cl.

CPC ..... *A63B 53/0487* (2013.01); *A63B 53/04* (2013.01); *A63B 53/0466* (2013.01); (Continued)

(58) Field of Classification Search

CPC ..... A63B 53/0487; A63B 53/04; A63B 60/00; A63B 53/0466; A63B 60/54; (Continued)

(56) References Cited

U.S. PATENT DOCUMENTS

| | | | |
|---|---|---|---|
| 1,289,553 | A | 12/1918 | Sanders |
| 1,562,956 | A | 11/1925 | Gueme |

(Continued)

FOREIGN PATENT DOCUMENTS

| | | |
|---|---|---|
| CN | 2082182 | 8/1991 |
| CN | 1221639 | 7/1999 |

(Continued)

OTHER PUBLICATIONS

Eric J. Barzeski, TaylorMade Rossa AGSI Putters Review, The Sand Trap, Aug. 26, 2005, Accessed on: Dec. 13, 2017, https://thesandtrap.com/b/clubs/taylormade_rossa_agsi_putters_review.

(Continued)

*Primary Examiner* — Sebastiano Passaniti

(57) ABSTRACT

Putters include a putter body having a ball striking face member made of a material having a first hardness characteristic. A cavity is defined in the putter body behind the ball striking face member, and plural openings are defined in the ball striking face member extending rearward with respect to the ball striking face member and into the cavity. A polymeric material at least partially fills the openings and the cavity, wherein the polymeric material has a second hardness characteristic that is softer than the first hardness characteristic. The ball striking face member and the polymeric material exposed in at least some of the openings provide a ball striking surface of the putter. The ball striking surface may include grooves or scorelines to affect the launch angle, spin, and/or roll of the ball during a putt. Methods for making such putter devices also are described.

20 Claims, 11 Drawing Sheets

Related U.S. Application Data continuation of application No. 15/268,873, filed on Sep. 19, 2016, now Pat. No. 10,029,160, which is a continuation of application No. 14/167,482, filed on Jan. 29, 2014, now Pat. No. 9,446,292, which is a continuation of application No. 13/657,546, filed on Oct. 22, 2012, now Pat. No. 8,641,549, which is a continuation of application No. 13/253,275, filed on Oct. 5, 2011, now Pat. No. 8,337,320, which is a continuation of application No. 12/906,901, filed on Oct. 18, 2010, now Pat. No. 8,083,605, which is a continuation of application No. 12/870,714, filed on Aug. 27, 2010, now Pat. No. 8,012,035, which is a continuation-in-part of application No. 12/467,812, filed on May 18, 2009, now Pat. No. 7,806,779, which is a continuation-in-part of application No. 12/123,341, filed on May 19, 2008, now Pat. No. 7,717,801.

(52) U.S. Cl.
CPC ..... *A63B 60/00* (2015.10); *A63B 60/54* (2015.10); *A63B 53/047* (2013.01); *A63B 2053/0416* (2013.01); *A63B 2053/0433* (2013.01); *A63B 2053/0441* (2013.01); *A63B 2053/0491* (2013.01); *A63B 2209/00* (2013.01); *Y10T 29/49993* (2015.01)

(58) Field of Classification Search
CPC ..... A63B 53/047; A63B 2053/0416; A63B 2053/0433; A63B 2053/0441; A63B 2053/0491; A63B 2209/00
USPC ..... 473/324–350, 287–292
See application file for complete search history.

(56) References Cited

U.S. PATENT DOCUMENTS 2,005,401 A 6/1935 Storz
2,429,351 A 10/1947 Fetterolf
3,084,940 A 4/1963 Cissel
D210,033 S 1/1968 Johnston
3,695,618 A 10/1972 Woolley et al.
3,970,236 A 7/1976 Rogers
3,975,023 A 8/1976 Inamori
3,979,125 A 9/1976 Lancellotti
4,679,792 A 7/1987 Straza et al.
D327,931 S 7/1992 Stuff
D327,932 S 7/1992 Stuff
5,248,145 A 9/1993 Brown
5,299,807 A 4/1994 Hutin
5,351,958 A 10/1994 Helmstetter
5,354,059 A 10/1994 Stuff
5,358,249 A 10/1994 Mendralla
5,398,929 A 3/1995 Kitaichi
5,403,007 A 4/1995 Chen
5,492,327 A 2/1996 Biafore, Jr.
5,497,993 A 3/1996 Shan
5,505,450 A 4/1996 Stuff
5,518,235 A 5/1996 Mendenhall
5,533,728 A 7/1996 Pehoski et al.
5,542,675 A 8/1996 Micciche et al.
5,620,381 A 4/1997 Spalding
5,624,331 A 4/1997 Lo et al.
5,637,044 A * 6/1997 Swash ..... A63B 53/0487 473/251
5,655,976 A 8/1997 Rife
5,755,626 A 5/1998 Shira
5,766,093 A 6/1998 Rohrer
5,769,737 A 6/1998 Holladay
5,772,527 A 6/1998 Liu
5,807,190 A 9/1998 Krumme et al.
5,944,619 A 8/1999 Cameron
5,972,144 A 10/1999 Hsu
6,083,117 A 7/2000 Hsu
6,200,229 B1 3/2001 Grace et al.
6,302,807 B1 10/2001 Rohrer
6,309,310 B1 10/2001 Shira
6,334,818 B1 1/2002 Cameron et al.
6,348,014 B1 2/2002 Chiu
6,431,997 B1 8/2002 Rohrer
6,558,272 B2 5/2003 Helmstetter
6,605,006 B2 8/2003 Mason
6,699,140 B1 3/2004 Sun
6,902,497 B2 6/2005 Deshmukh et al.
6,921,343 B2 7/2005 Solheim
6,932,716 B2 8/2005 Ehlers et al.
D532,070 S 11/2006 Solari
7,166,039 B2 1/2007 Hettinger et al.
7,261,644 B2 8/2007 Burrows
D553,702 S 10/2007 Frame et al.
7,278,926 B2 10/2007 Frame
7,281,990 B2 10/2007 Hagood et al.
7,303,487 B2 12/2007 Kumamoto
7,347,796 B2 3/2008 Takeda
D570,934 S 6/2008 Ban
D572,786 S 7/2008 Ban et al.
7,442,129 B2 10/2008 Bardha
7,465,240 B2 12/2008 Frame
7,470,201 B2 12/2008 Nakahara et al.
7,473,186 B2 1/2009 Best et al.
D588,221 S 3/2009 Takahashi
D588,666 S 3/2009 Takahashi
D594,921 S 6/2009 Bettinardi
7,582,024 B2 9/2009 Shear
7,594,862 B2 9/2009 Gilbert
7,594,863 B2 9/2009 Ban
D605,242 S 12/2009 Franklin et al.
7,632,195 B2 12/2009 Jorgensen
7,670,232 B2 3/2010 Franklin
D615,140 S 5/2010 Franklin et al.
7,717,801 B2 * 5/2010 Franklin ..... A63B 53/0487 473/251
7,758,449 B2 7/2010 Gilbert et al.
7,780,549 B2 8/2010 Park
7,794,333 B2 9/2010 Wallans
7,806,779 B2 * 10/2010 Franklin ..... A63B 53/04 473/251
7,824,278 B2 11/2010 Miyamichi
7,841,952 B1 11/2010 Oldknow et al.
7,846,039 B2 12/2010 Gilbert et al.
7,862,449 B2 1/2011 Stites et al.
7,927,230 B2 4/2011 Solheim
7,938,738 B2 5/2011 Roach
7,942,757 B2 5/2011 Blumenkrantz et al.
7,942,758 B2 5/2011 Nakamura
8,012,035 B2 * 9/2011 Franklin ..... A63B 53/0466 473/251
8,062,146 B2 * 11/2011 Franklin ..... A63B 53/0487 473/251
8,066,587 B2 11/2011 Tateno
8,083,605 B2 * 12/2011 Franklin ..... A63B 53/0487 473/251
8,083,611 B2 12/2011 Kuan et al.
8,210,962 B2 * 7/2012 Franklin ..... A63B 53/0487 473/251
8,216,081 B2 * 7/2012 Snyder ..... A63B 53/04 473/251
8,287,401 B2 10/2012 Tateno et al.
8,292,754 B2 * 10/2012 Snyder ..... A63B 53/04 473/251
8,337,320 B2 * 12/2012 Franklin ..... A63B 53/04 473/251
8,425,341 B2 4/2013 Takechi et al.
8,425,342 B2 * 4/2013 Snyder ..... A63B 53/007 473/251
8,506,415 B2 8/2013 Franklin
8,550,932 B2 * 10/2013 Franklin ..... A63B 53/0487 473/251
8,579,717 B2 * 11/2013 Snyder ..... A63B 53/04 473/251

(56) References Cited

U.S. PATENT DOCUMENTS

| | | | | |
|---|---|---|---|---|
| 8,641,549 | B2 * | 2/2014 | Stites | A63B 53/04 473/251 |
| 8,747,245 | B2 * | 6/2014 | Franklin | A63B 53/04 473/251 |
| 8,747,425 | B2 | 6/2014 | Franklin | |
| 8,814,715 | B2 * | 8/2014 | Franklin | A63B 53/0487 473/251 |
| 8,834,285 | B2 | 9/2014 | Franklin et al. | |
| 9,446,292 | B2 * | 9/2016 | Stites | A63B 60/54 |
| 10,029,160 | B2 * | 7/2018 | Stites | A63B 53/0487 |
| 10,369,434 | B2 * | 8/2019 | Stites | A63B 60/00 |
| 2003/0220156 | A1 | 11/2003 | Solheim | |
| 2004/0038745 | A1 * | 2/2004 | Ahlqvist | A63B 53/04 473/331 |
| 2004/0180730 | A1 | 9/2004 | Franklin | |
| 2004/0242342 | A1 | 12/2004 | Patten | |
| 2005/0009623 | A1 | 1/2005 | Dickinson | |
| 2005/0209020 | A1 | 9/2005 | Burrows | |
| 2005/0233829 | A1 | 10/2005 | Cameron | |
| 2006/0172817 | A1 | 8/2006 | Dewanjee | |
| 2007/0054752 | A1 | 3/2007 | Lai | |
| 2007/0142122 | A1 | 6/2007 | Bonneau | |
| 2007/0243949 | A1 | 10/2007 | Solari | |
| 2008/0125240 | A1 | 5/2008 | Tateno et al. | |
| 2008/0125241 | A1 | 5/2008 | Tateno et al. | |
| 2008/0234066 | A1 | 9/2008 | Jones et al. | |
| 2008/0293511 | A1 | 11/2008 | Gilbert | |
| 2009/0105008 | A1 | 4/2009 | Kuan et al. | |
| 2009/0131197 | A1 | 5/2009 | Miyamichi | |
| 2009/0149271 | A1 | 6/2009 | Nakamura | |
| 2010/0113179 | A1 | 5/2010 | Solheim | |

FOREIGN PATENT DOCUMENTS

| | | |
|---|---|---|
| CN | 2348876 | 11/1999 |
| CN | 1255873 | 6/2000 |
| CN | 1669605 | 9/2005 |
| CN | 101049534 | 10/2007 |
| GB | 2313552 | 12/1997 |
| GB | 2388792 | 11/2003 |
| JP | 08196666 | 8/1996 |
| JP | H0984909 | 3/1997 |
| JP | 09-164230 | 6/1997 |
| JP | 2000093566 | 4/2000 |
| JP | 2001062012 | 3/2001 |
| JP | 2003-777 | 1/2003 |
| JP | 2003-778 | 1/2003 |
| JP | 2003250933 | 9/2003 |
| JP | 2004-290565 | 10/2004 |
| JP | 2005-52644 | 3/2005 |
| JP | 2005103162 | 4/2005 |
| JP | 2005-287778 | 10/2005 |
| JP | 2007236945 | 9/2007 |
| JP | 2008154975 | 7/2008 |
| JP | 4215813 B1 | 1/2009 |
| JP | 2011-502727 | 1/2011 |
| JP | 2013-013752 | 1/2013 |
| KR | 20080047955 | 5/2008 |
| TW | M330106 | 4/2008 |
| TW | 200936200 | 9/2009 |
| WO | 2009143052 | 11/2009 |

OTHER PUBLICATIONS

C-Groove- Development, Harold Swash Putting School of Excellence (Aug. 26, 2008), http://www.haroldswashputting.co.uk/haroldswash_development.htm.

Hybrid Blade Putter from Rife Putters; http://www.rifeputters.com/products/hybrid/20/two-bar-hybrid- blade/ copyright 2008, visited website Aug. 5, 2009.

Rife Two Bar Hybrid Putter Review, Putter Zone Golf (Mar. 7, 2008), http://www.putterzone.com/2008/03/rife-two-bar-hybrid-putter-review.html.

European Patent Office, European Search Report received in European Patent Application No. 12198442.1 dated Mar. 19, 2013.

International Preliminary Report on Patentability received in PCT Application No. PCT/US2009/044331 dated Nov. 23, 2010.

European Search Report received in corresponding European Application No. 11159319.0 dated Sep. 23, 2011.

International Search Report and Written Opinion received in PCT Application No. PCT/US2010/051432 dated Mar. 30, 2011.

International Search Report and Written Opinion received in PCT Application No. PCT/US2009/044331 dated Sep. 10, 2009.

International Search Report and Written Opinion received in PCT Application No. PCT/US2011/028674 dated Jul. 18, 2011.

Taiwanese Patent Office, Search Report issued in Taiwanese Patent Application No. 9913400 dated Mar. 12, 2013.

Taiwanese Patent Office, Search Report issued in Taiwanese Patent Application No. 100109547 dated Mar. 14, 2013.

* cited by examiner

GOLF CLUB HEADS

RELATED APPLICATION DATA

This is a continuation of U.S. patent application Ser. No. 16/029,415 filed Jul. 6, 2018, which is a continuation of U.S. patent application Ser. No. 15/268,873 filed Sep. 19, 2016, now U.S. Pat. No. 10,029,160 issued Jul. 24, 2018, which is a continuation of U.S. patent application Ser. No. 14/167,482, filed Jan. 29, 2014, now U.S. Pat. No. 9,446,292 issued Sep. 20, 2016, which is a continuation of U.S. patent application Ser. No. 13/657,546, filed Oct. 22, 2012, now U.S. Pat. No. 8,641,549, issued Feb. 4, 2014, which is a continuation of U.S. patent application Ser. No. 13/253,275, filed Oct. 5, 2011, now U.S. Pat. No. 8,337,320, issued Dec. 25, 2012, which is a continuation of U.S. patent application Ser. No. 12/906,901, filed Oct. 18, 2010, now U.S. Pat. No. 8,083,605, issued Dec. 27, 2011, which is a continuation of U.S. patent application Ser. No. 12/870,714, filed Aug. 27, 2010, now U.S. Pat. No. 8,012,035, issued Sep. 6, 2011, which is a continuation of U.S. patent application Ser. No. 12/467,812, filed May 18, 2009, now U.S. Pat. No. 7,806,779, issued Oct. 5, 2010, which is a continuation-in-part of U.S. patent application Ser. No. 12/123,341, filed May 19, 2008, now U.S. Pat. No. 7,717,801, issued May 18, 2010, the contents of all of which are fully incorporated by reference.

FIELD OF THE INVENTION

The invention relates generally to putter heads and putters. Putter heads and putters in accordance with at least some examples of this invention may be constructed to include a relatively soft polymeric material as at least a portion of the ball striking face.

BACKGROUND

Golf is enjoyed by a wide variety of players—players of different genders and players of dramatically different ages and skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with increased availability of golf programming on television (e.g., golf tournaments, golf news, golf history, and/or other golf programming) and the rise of well known golf superstars, at least in part, have increased golf's popularity in recent years both in the United States and across the world. The number of individuals participating in the game and the number of golf courses have increased steadily over recent years.

Golfers at all skill levels seek to improve their performance, lower their golf scores, and reach that next performance "level." Manufacturers of all types of golf equipment have responded to these demands, and recently, the industry has witnessed dramatic changes and improvements in golf equipment. For example, a wide range of different golf ball models now are available, with some balls designed to complement specific swing speeds and/or other player characteristics or preferences, e.g., with some balls designed to fly farther and/or straighter, some designed to provide higher or flatter trajectories, some designed to provide more spin, control, and/or feel (particularly around the greens), etc. A host of swing aids and/or teaching aids also are available on the market that promise to help lower one's golf scores.

Being the sole instruments that set golf balls in motion during play, golf clubs also have been the subject of much technological research and advancement in recent years. For example, the market has seen improvements in putter designs, golf club head designs, shafts, and grips in recent years. Additionally, other technological advancements have been made in an effort to better match the various elements and/or characteristics of the golf club and/or characteristics of a golf ball to a particular user's swing features or characteristics (e.g., club fitting technology, ball launch angle measurement technology, ball spin rate characteristics, etc.).

Golfers tend to be sensitive to the "feel" of a golf club, particularly with respect to putters. The "feel" of a golf club comprises the combination of various component parts of the club and various features associated with the club that produce the sensory sensations experienced by the player when a ball is swung at and/or struck. Club "feel" is a very personal characteristic in that a club that "feels" good to one user may have totally undesirable "feel" characteristics for another. Club weight, weight distribution, aerodynamics, swing speed, and the like all may affect the "feel" of the club as it swings and strikes a ball. "Feel" also has been found to be related to the visual appearance of the club and the sound produced when the club head strikes a ball to send the ball in motion.

While technological improvements to golf club designs have been made, because of the very personal nature of the putter stroke and the "feel" aspects of putting a golf ball, no single putter structure is best suited for all players. New putter structures that change the look and feel of the club are welcomed by at least some players.

SUMMARY

The following presents a general summary of aspects of the invention in order to provide a basic understanding of this invention. This summary is not intended as an extensive overview of the invention. It is not intended to identify key or critical elements of the invention or to delineate the scope of the invention. The following summary merely presents some concepts of the invention in a general form as a prelude to the more detailed description provided below.

Aspects of this invention relate to putters and putter heads that include: (a) a putter body (made from one or multiple independent pieces or parts) including a ball striking face member made of a material having a first hardness characteristic, wherein a cavity is defined in the putter body behind the ball striking face member, and wherein a plurality of independent and separated openings are defined in the ball striking face member, the independent and separated openings extending rearward with respect to the ball striking face member so as to open into the cavity; (b) a polymeric material provided to at least partially fill the plurality of openings and the cavity, wherein the polymeric material has a second hardness characteristic that is softer than the first hardness characteristic, and wherein the ball striking face member and the polymeric material exposed in at least some of the openings provide a ball striking surface of the putter head; (c) a shaft (or other handle) member engaged with the putter body; and/or (d) a grip member engaged with the shaft member (or other handle member). The polymeric material may completely fill the plurality of openings and the cavity.

The polymeric material generally will lighten the club head structure, and thus allow a club designer to provide weight at other locations in the club head structure (e.g., to increase the club head's moment of inertia characteristics, to control the center of gravity location, etc.). Additionally, the presence of the polymeric material at the ball striking surface (and in contact with the ball during a putt) will influence the ball spin, as well as the sound and "feel" characteristics of the putter (e.g., due to vibration damping effects of the polymeric material).

If desired, the ball striking surface of putter structures in accordance with at least some examples of this invention may include a plurality of grooves defined therein (also call "scorelines"). The grooves or scorelines can help control and produce desired launch angles and/or spin rates of a golf ball during a putt. The grooves may be defined in the material making up the ball striking face member (e.g., between adjacent openings in the ball striking face member), in the polymeric material, or in both the material making up the ball striking face member and the polymeric material. If desired, a single continuous groove may be partially provided in the polymeric material and partially provided in the ball striking face member material immediately adjacent to the polymeric material.

Additional aspects of this invention also relate to methods for making putters and putter heads, e.g., of the various types described above.

BRIEF DESCRIPTION OF THE DRAWINGS

A more complete understanding of the present invention and certain advantages thereof may be acquired by referring to the following detailed description in consideration with the accompanying drawings, in which like reference numbers indicate like features, and wherein.

DETAILED DESCRIPTION

Figure 1A:
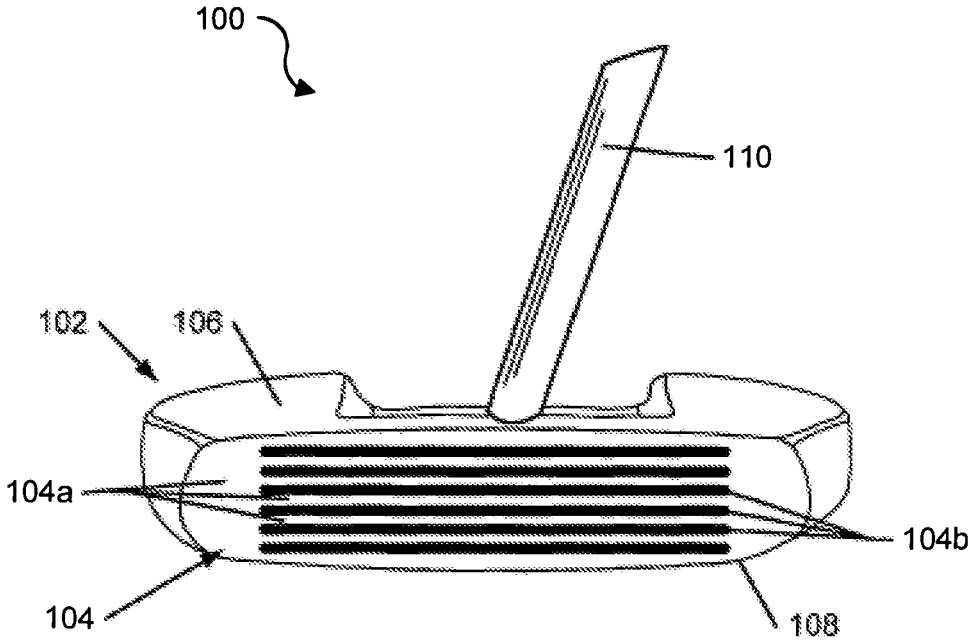
FIGS. 1A and 1B illustrate an example putter structure in accordance with this invention.

In the following description of various example putter heads and other aspects of this invention, reference is made to the accompanying drawings, which form a part hereof, and in which are shown by way of illustration various example structures, systems, and steps in which aspects of the invention may be practiced. It is to be understood that other specific arrangements of parts, structures, example devices, systems, and steps may be utilized and structural and functional modifications may be made without departing from the scope of the present invention. Also, while the terms "top," "bottom," "front," "back," "side," and the like may be used in this specification to describe various example features and elements of the invention, these terms are used herein as a matter of convenience, e.g., based on the example orientations shown in the figures and/or the orientations during typical use. Nothing in this specification should be construed as requiring a specific three dimensional orientation of structures in order to fall within the scope of this invention.

At least some example aspects of this invention relate to putters and putter heads, as well as to methods of making such structures. A general description of aspects of the invention followed by a more detailed description of specific examples of the invention follows.

A. General Description of Putters, Putter Heads, and Methods According to Aspects of the Invention In general, aspects of this invention relate to putters and putter heads. Such golf clubs, according to at least some examples of the invention, may include: (a) a putter body (made from one or multiple independent pieces or parts) including a ball striking face member made of a material having a first hardness characteristic, wherein a cavity is defined in the putter body behind the ball striking face member, and wherein a plurality of independent and separated openings are defined in the ball striking face member, the independent and separated openings extending rearward with respect to the ball striking face member so as to open into the cavity; (b) a polymeric material provided to at least partially fill the plurality of openings and the cavity, wherein the polymeric material has a second hardness characteristic that is softer than the first hardness characteristic, and wherein the ball striking face member and the polymeric material exposed in at least some of the openings provide a ball striking surface of the putter head; (c) a shaft (or other handle) member engaged with the putter body; and/or (d) a grip member engaged with the shaft member (or other handle member). If desired, the polymeric material may completely fill the plurality of openings and the cavity.

If desired, the ball striking surface of putter structures in accordance with at least some examples of this invention may include a plurality of grooves defined therein (also call "scorelines"). The grooves may be defined in the material making up the ball striking face member (e.g., between adjacent openings in the ball striking face member), in the polymeric material, or in both the material making up the ball striking face member and the polymeric material. If desired, a single continuous groove may be partially provided in the polymeric material and partially provided in the ball striking face member material immediately adjacent to the polymeric material.

The plurality of openings in the ball striking face member may be arranged and oriented in a wide variety of ways without departing from this invention. For example, the openings may extend in a parallel or substantially parallel manner across the ball striking surface (e.g., such that the material of the ball striking face member extends between two adjacent openings). The openings may be formed as one or more elongated slots. As additional examples, at least some of the openings may form a design, logo, and/or alphanumeric characters on the ball striking surface. Additionally, any number of openings in any desired arrangement may be provided on the ball striking surface without departing from this invention.

The openings may be sized and arranged in a variety of different manners without departing from this invention. For example, in some putter head products in accordance with this invention, two adjacent openings may be separated by a distance ranging from 0.03 to 0.5 inches, and in some examples, by a distance of 0.1 to 0.3 inches. This separation distance corresponds to the dimensions of the ball striking face member material between adjacent openings. This separation distance may be constant or it may vary along the length of the openings. Likewise, this separation distance may be constant or it may vary among the adjacent openings present in the ball striking face member. Similarly, the openings themselves may have a variety of dimensions without departing from this invention. For example, the openings may extend all the way across the ball striking surface or partially across the ball striking surface (e.g., 10-80% of the way across the ball striking surface, and from 25-75% of the way across the ball striking surface in some examples). The openings may have a height dimension (in the putter head top-to-bottom direction) of any desired value, e.g., ranging from 0.03 to 0.5 inches, and in some example structures from 0.1 to 0.3 inches.

If desired, the cavity defined in the putter body may extend to and open at a port located at an exterior surface of the putter body (e.g., to allow introduction of the polymeric material in to the cavity and/or in to the openings during manufacture). This cavity access port may be located, for example, at a bottom surface of the putter body, at a top surface of the putter body, and/or at a rear surface of the putter body. More than one cavity access port may be provided in a putter head structure without departing from this invention. If desired, when exposed at the top surface of the putter body, the polymeric material (or a cover member provided in the cavity access port) may form at least a portion of an alignment aid for the putter head. The access port may be shaped to provide additional alignment aid features.

The openings may extend rearward from the ball striking surface of the putter body (to the cavity) in any desired manner without departing from this invention. For example, at least some of the plurality of independent and separated openings in a putter body may extend rearward from the ball striking surface in a direction substantially perpendicular to the ball striking surface. In other example structures, at least some of the plurality of independent and separated openings may extend rearward from the ball striking surface at a non-perpendicular angle with respect to the ball striking surface, e.g., at an angle of 10° to 80°, and in some examples structures, at any angle within the range of 30° to 60°. The openings also may extend rearward in a curved or other non-linear or irregular manner.

Additional aspects of this invention relate to methods for making putter devices (such as putters and putter heads of the types described above). Such methods may include, for example: (a) providing a putter body (e.g., by manufacturing it, by obtaining it from a third party source, etc.) including a ball striking face member made of a material having a first hardness characteristic, wherein a cavity is defined in the putter body behind the ball striking face member, and wherein a plurality of independent and separated openings are defined in the ball striking face member, the independent and separated openings extending rearward with respect to the ball striking face member so as to open into the cavity; (b) placing a polymeric material in the putter body to at least partially fill the plurality of openings and the cavity, wherein the polymeric material has a second hardness characteristic that is softer than the first hardness characteristic, and wherein the polymeric material is inserted such that the ball striking face member and the polymeric material exposed in at least some of the openings provide a ball striking surface of the putter head; (c) attaching a shaft member to the putter body; and/or (d) attaching a grip member to the shaft member. The putter devices may have any of the various characteristics described above.

Specific examples of the invention are described in more detail below. The reader should understand that these specific examples are set forth merely to illustrate examples of the invention, and they should not be construed as limiting the invention.

B. Specific Examples of the Invention

The various figures in this application illustrate examples of putters, components thereof, and methods in accordance with examples of this invention. When the same reference number appears in more than one drawing, that reference number is used consistently in this specification and the drawings to refer to the same or similar parts throughout.

Figure 1B:
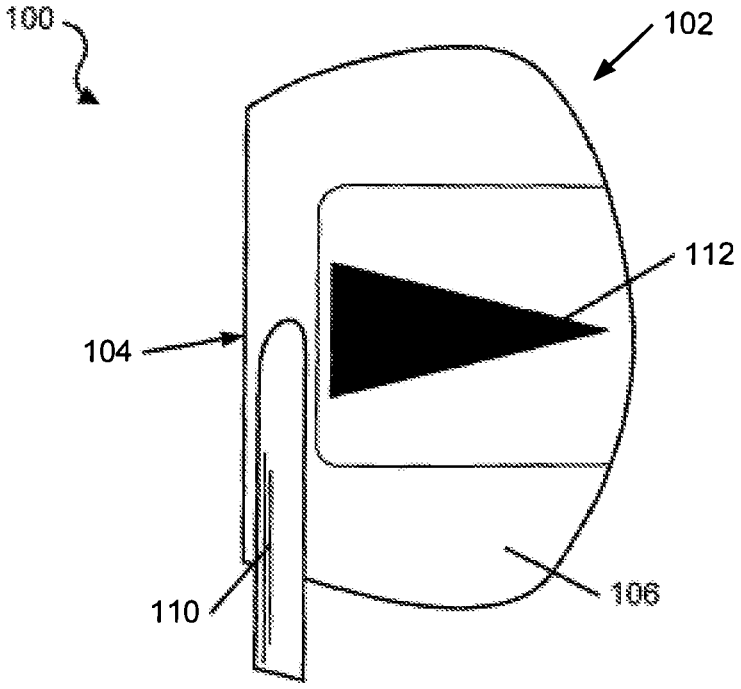

FIGS. 1A and 1B illustrate an example putter structure 100 in accordance with this invention. The putter 100 includes a putter head 102 having a ball striking face 104, a top portion 106, a bottom portion 108, and a shaft member 110 engaged with the putter head 102. The top portion 106 of the putter head 102 may include an alignment aid 112 having any desired shape, structure, etc. The putter head 102 may be made from any desired materials without departing from this invention, including, for example, metals, metal alloys, and the like, including materials that are conventionally known and used in the art. Likewise, the shaft member 110 may be made of any desired materials without departing from this invention, including, for example, metals, metal alloys, composites, and the like, including materials that are conventionally known and used in the art.

As illustrated in FIG. 1A, the ball striking face 104 of the putter head 102 includes at least two different surface features. One portion 104*a* of the putter head 102 is made from the base material for the ball striking face, such as the materials described above for the putter head 102 or other conventional materials used for putter ball striking faces. Another portion 104*b* of the putter head 102 is made from a polymeric material. The polymeric material generally will be softer and more lightweight as compared to the material of the remainder of the ball striking face 104, including portions 104*a*. As illustrated in FIG. 1A, in this example structure, the two portions 104*a* and 104*b* of the ball striking face 104 extend across the ball striking surface of the putter head 102 in an alternating manner, such that a plurality of parallel strips of polymeric material 104*b* are separated by a plurality of strips of the ball striking face material 104*a*. Examples of the construction of putter heads to include this alternating material structure will be described in more detail below.

One potential advantage of providing a polymeric material within a putter head relates to the potential for weight savings. By removing some of the metal material from the putter head body, this material may be replaced by a lighter weight polymeric material. This weight savings allows the club designer to place additional weight at other areas of the putter head structure, such as toward the rear corners of the putter head structure. Such features may allow the club designer to control and design a club having higher moment of inertia (resistance to twisting) and desired center of gravity location characteristics. Additionally, by including this relatively soft polymeric material 104*b* as part of the ball striking face (such that the polymeric material 104*b* also directly contacts the ball during a putt), the ball strike characteristics of the putter head may be altered and controlled, which affects the sound, rebound, and other "feel" characteristics of the putter head (e.g., by damping vibrations and altering the sound of a ball strike). The polymeric material 104*b* also may influence ball spin as the ball comes off the putter face.

Figure 2A:
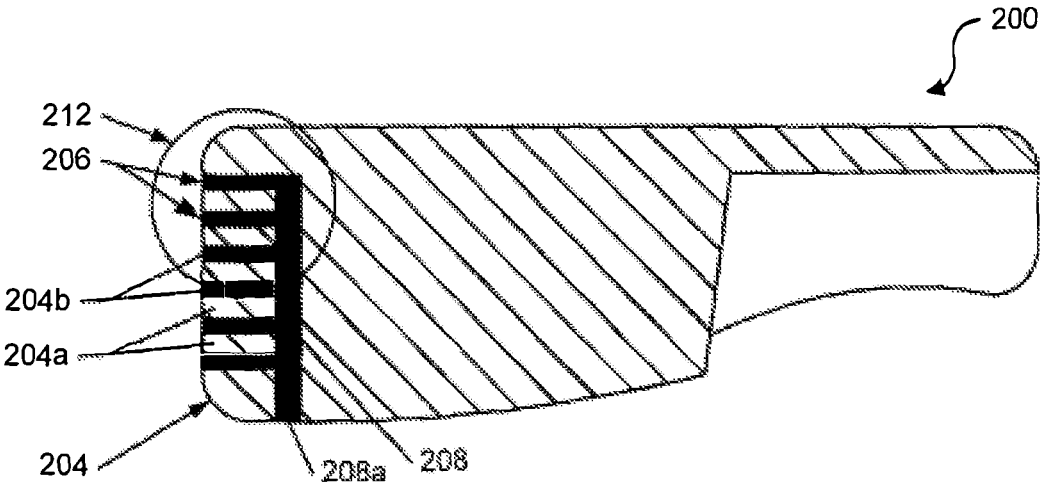
FIGS. 2A through 2D illustrate additional features of a polymer filled putter head in accordance with examples of this invention.

FIGS. 2A through 2D illustrate additional details of a putter head structure 200 in accordance with at least some examples of this invention. FIG. 2A is a cross sectional view taken along a center line of a putter head 200 (between the putter head's heel and toe direction), e.g., like the putter head 102 illustrated in FIGS. 1A and 1B. As shown in FIG. 2A, like FIG. 1A above, the ball striking face 204 of the putter head 200 includes two distinct portions 204*a* and 204*b*, namely, a portion 204*a* made up of the material making the main portion of the ball striking face 204 and a portion 204*b* made from a polymeric material as described above. The polymeric material portion 204*b* is filled into openings (e.g., slots) 206 defined in the ball striking surface 204 of the putter head 200. The openings 206 may be formed in the ball striking face 204 of the putter head 200 in any desired manner without departing from this invention, including, for example, forming the ball striking face 204 to include such openings 206 (e.g., during the molding, casting, forging, or other production process), machining such openings 206 in a solid block of the putter head material, etc. Any desired number of openings 206 may be provided in a ball striking face 204 without departing from this invention.

The openings 206 open at their rear ends into an open cavity structure 208 defined in the putter head structure 200. This cavity structure 208 may be formed in the putter head 200 in any desired manner without departing from this invention, including, for example, forming the putter head 200 to include such a cavity 208 (e.g., during the molding, casting, forging, or other production process), machining such a cavity 208 in a solid block of the putter head material, etc. While a single cavity 208 is illustrated in FIG. 2A and all of the openings 206 open in to this single cavity 208, if desired, multiple cavities 208 may be provided in a putter head structure 200, and the openings 206 may open into any one or more of the available cavities without departing from this invention. In this illustrated example structure, the cavity 208 includes an access port member 208*a* provided in the bottom surface 210 of the putter head structure 200.

Figure 2B:
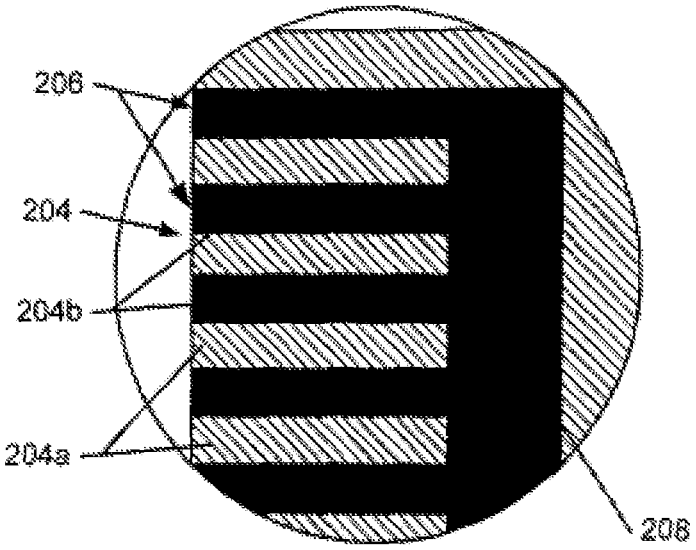

FIG. 2B illustrates an enlarged portion of the putter head structure 200 shown in FIG. 2A (the encircled portion 212 from FIG. 2A). As shown, the ball striking surface 204 includes both the metal (or other) material 204*a* of the ball striking surface of the putter head 200 and the exposed polymeric material 204*b* present in the openings 206 defined in the ball striking surface 204. The openings 206 (and thus the height of the exposed polymeric material 204*b* in the top-to-bottom direction on the ball striking face surface 204) may be made of any desired size without departing from this invention. For example, these openings 206 (and thus the height of the exposed polymeric material 204*b*) may be in the range of 0.03 to 0.5 inches, and in some examples, from about 0.1 to 0.3 inches. Likewise, the height of the metal (or other) material 204*a* between adjacent openings 206 (and thus between adjacent portions 204*b* of the polymeric material) may be made of any desired size without departing from this invention. For example, the height of these portions 204*a* may be in the range of 0.03 to 0.5 inches, and in some examples, from about 0.1 to 0.3 inches. The heights of the portions 204*a* may be less than, equal to, or greater than the heights of the portions 204*b* in a given putter head structure. Additionally, the portions 204*a* and 204*b* may be of a constant size or of different sizes in a given putter head structure without departing from this invention. The heights of these portions 204*a* and 204*b* also may change over the course of the length of the individual portions 204*a* and 204*b* (e.g., in a heel-to-toe direction of the putter ball striking face). A wide variety of potential combinations of sizes of the various portions 204*a* and 204*b* are possible.

The cavity 208 may be placed at any desired position and in any desired orientation in the putter head structure 200 without departing from this invention (and thus, the openings 206 may extend in to the putter head structure 200 any desired distance without departing from this invention). For example, at least some portions of the cavity 208 may be oriented from about 0.25 to 2 inches rearward from the ball striking surface, and in some examples, from about 0.25 to 1 inch rearward. Also, while the illustrated cavity 208 is generally parallel to the ball striking face 204, this is not a requirement. Rather, the cavity 208 can have any desired size, shape, orientation, and orientation with respect to the ball striking face 204 without departing from this invention. As some more specific examples, the cavity 208 may extend in a top-to-bottom direction ranging from 50-95% of the overall putter head height at the location of the cavity 208; the cavity 208 may extend rearward by a distance ranging from 0.25 to 6 inches, and in some examples, from 0.5 to 4 inches or even from 0.5 to 3 inches; and the cavity 208 as well as its port 208*a* may extend in a heel-to-toe direction ranging from 5-95% of the overall putter head heel-to-toe length dimension at the location of the cavity 208 (and in some examples, from 15-85% or even from 25-75% of the overall heel-to-toe dimension at the location of the cavity 208).

Figure 2C:
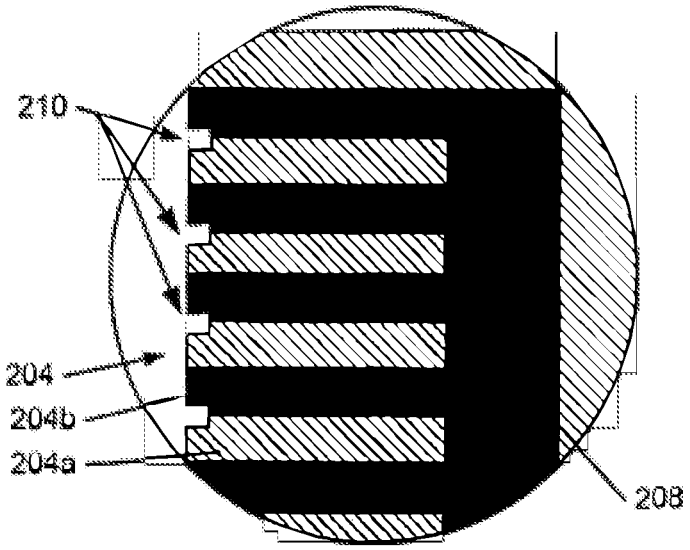
Figure 2D:
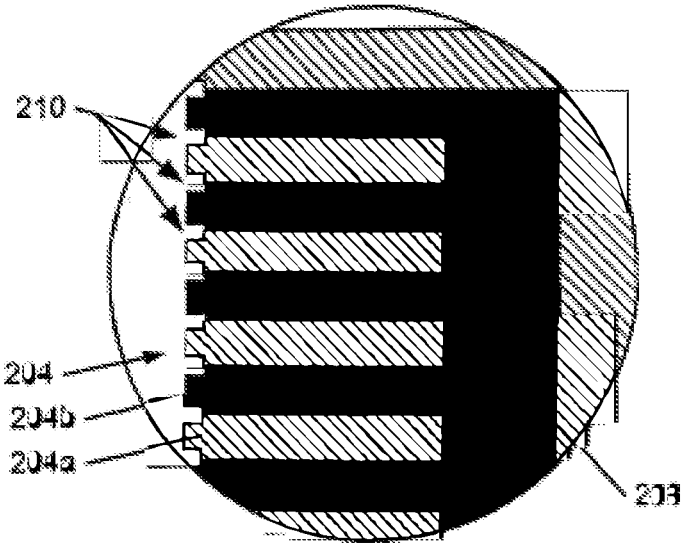

As illustrated in FIG. 2B, the ball striking surface 204 may be smooth (e.g., the portions 204*a* and 204*b* may smoothly transfer from one portion to the next in the alternating portion structure). The ball striking surface 204 may be flat, or it may include some roll or bulge characteristics, and/or it may have some desired loft characteristic. This flat and/or smooth surface 204 is not a requirement. To the contrary, as illustrated in FIGS. 2C and 2D, the ball striking surface 204 may include grooves or scorelines 210 formed therein. In these illustrated example structures, the scorelines 210 are formed at an area of the ball striking surface 204 bridging the junctions between the metal portion 204*a* and the polymeric portion 204*b* of the ball striking surface 204 such that the scorelines 210 are cut into each of these materials 204*a* and 204*b*. The scorelines 210 may be integrally formed in the portions 204*a* and 204*b* when the various parts of the ball striking face 204 are formed (e.g., during the molding, casting, forging, or other forming process), and/or they may be formed at a later time (e.g., after the polymeric material is introduced into the putter head structure and hardened, e.g., by a cutting or machining process). FIG. 2C illustrates an example putter face structure in which the scorelines 210 are formed at the junctions of the bottom of a polymeric portion 204*b* and the top of the adjacent metal portion 204*a*. If desired, this structure could be flipped such that the scorelines 210 are formed at the junctions of the top of a polymeric portion 204*b* and the bottom of the adjacent metal portion 204*a*. FIG. 2D, on the other hand, illustrates another example putter face structure in which the scorelines 210 are formed: (a) at the junctions of the bottom of a polymeric portion 204*b* and the top of the adjacent metal portion 204*a* and (b) at the junctions of the top of a polymeric portion 204*b* and the bottom of the adjacent metal portion 204*a*. In other words, in the structure of FIG. 2C, at least some of the metal portions 204*a* and the polymeric portions 204*b* have a single groove defined therein, whereas in the structure of FIG. 2D, at least some of the metal portions 204*a* and the polymeric portions 204*b* have a two grooves defined therein (one groove at their top and one groove at their bottom).

Providing scorelines (e.g., like scorelines 210) can affect the manner in which the ball leaves the putter head during the course of a putt. For example, the scorelines 210 can affect launch angle and/or ball spin as the ball leaves the putter face during a putt. As one more specific example, in at least some instances, the scorelines 210 and the polymeric material 204*b* will grip the ball somewhat and produce top spin on the ball when putted, which tends to get the ball rolling earlier and truer (e.g., and eliminates some early bouncing during a putt).

The scorelines 210 may have any desired height without departing from this invention. For example, if desired, the scorelines 210 may extend up to 10% of the height of the portion 204*a* and/or 204*b* into which it is provided, and in some examples, up to 25% or even up to 50% or 75% of this height. The scorelines 210 may extend into the portions 204*a* and/or 204*b* (in the front-to-rear or depth direction) a distance of about 0.25 to 2 times the scoreline's height, and in some examples, from 0.5 to 1.5 times the scoreline's height. The various scorelines 210 on a putter face 204 may have the same or different sizes and/or shapes, and every junction and/or every portion 204*a* and/or 204*b* on a given putter structure need not include an associated scoreline 210.

Figure 3:
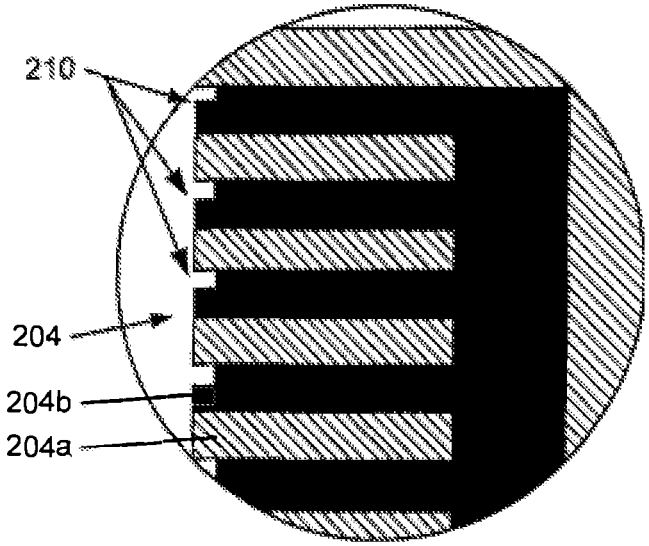
FIGS. 3 and 4 illustrate alternative features of grooves or scorelines that may be included in putter structures in accordance with at least some examples of this invention.
Figure 4:
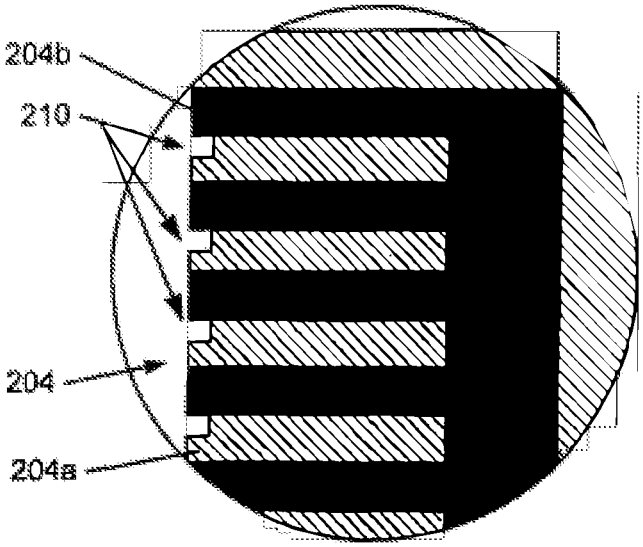

The scorelines 210 may have other constructions without departing from this invention. For example, as illustrated in FIG. 3, the scorelines 210 may be formed solely in the material making up the polymeric portion 204*b* of the ball striking face structure 204. Alternatively, as illustrated in FIG. 4, the scorelines 210 may be formed solely in the material making up the metal (or other base material) portion 204*a* of the ball striking face structure 204. As yet another example, if desired, scorelines 210 of the types illustrated in FIGS. 2C, 2D, 3, and/or 4 may be combined in a single putter head structure without departing from this invention. Also, if desired, in the structures of FIGS. 3 and 4, grooves may be provided at both the tops and the bottoms of the polymeric portions 204*b* (FIG. 3) or the metal portions 204*a* (FIG. 4), without departing from this invention.

Figure 5:
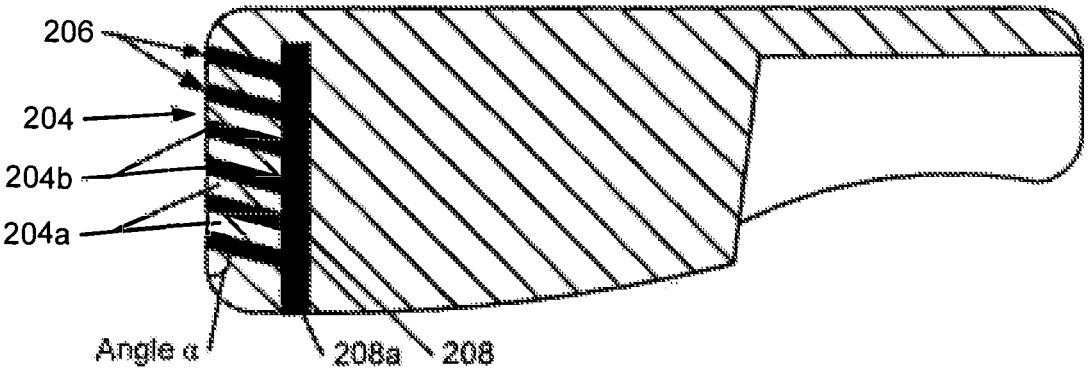
FIGS. 5 through 9 illustrate alternative features of the openings, cavities, and port arrangements that may be included in putter structures in accordance with at least some examples of this invention.

FIGS. 5-9 illustrate additional potential features of putter head structures in accordance with at least some examples of this invention. For example, FIG. 2A illustrates the openings 206 extending rearward from the ball striking face 204 in a direction generally perpendicular to the ball striking face 204. This is not a requirement. For example, as illustrated in FIG. 5, the openings 206 may extend rearward from the ball striking face 204 at a non-perpendicular angle (angle $\alpha$) with respect to the ball striking face. This angle $\alpha$ may be in the range of 10-80°, and in some putter structures, in the range of 30-60°. Of course, the openings 206 in a given putter head structure need not extend rearward in parallel (in other words, the rearward extension angle $\alpha$ of the various openings 206 may vary in a single putter head structure without departing from this invention).

Figure 6:
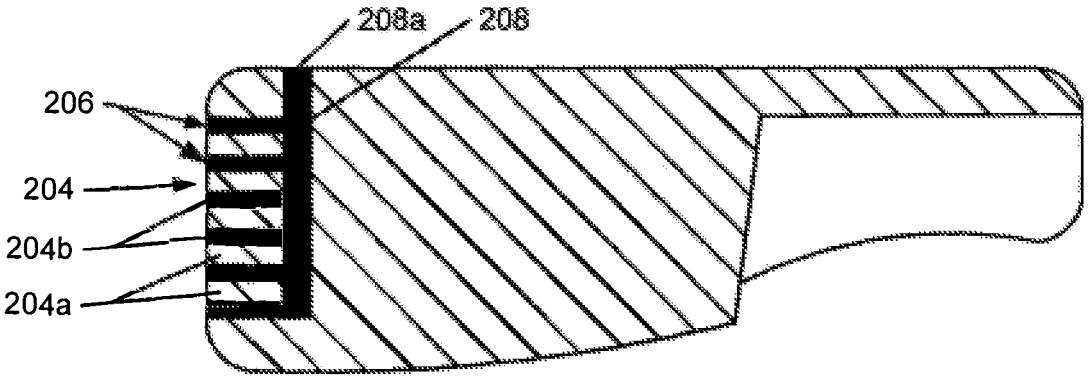

Other variations in the putter head structure are possible without departing from this invention. For example, the port 208*a* of the cavity 208 need not be in the bottom surface of the putter head, as shown in FIG. 2A. Rather, as shown in FIG. 6, the port 208*a* may be provided in the top surface of the putter head. In this manner, if desired (and as will be described in more detail below in conjunction with FIG. 15), the visible polymeric (or other material) present at the port 208*a* may provide at least a portion of an alignment aid for the putter head. While the polymeric material within the cavity 208 may be exposed at the port 208*a* (and at any of the ports described above), if desired, the port 208*a* may be closed by a cover element so that the polymeric material is not directly exposed to the exterior environment at the port 208*a*.

Figure 7:
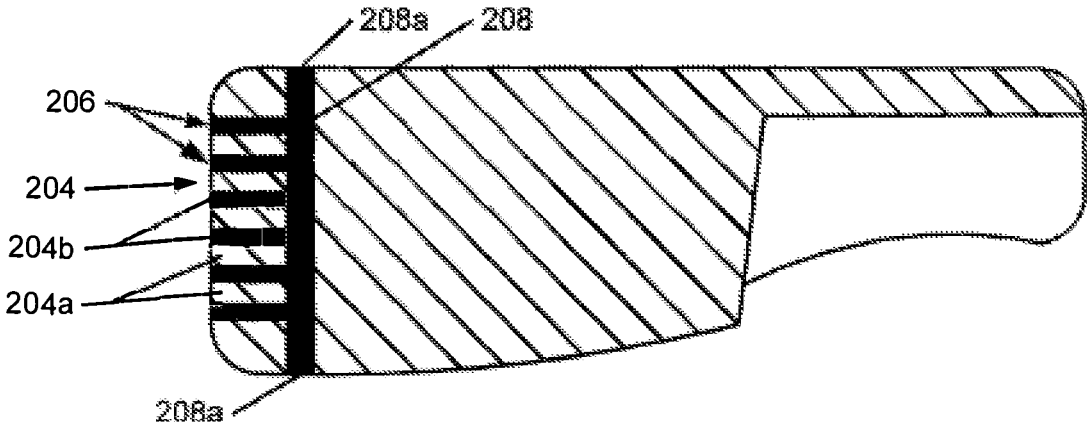

As another potential alternative structure, if desired, more than one port 208*a* may be provided with access to the cavity 208. For example, FIG. 7 illustrates a putter head structure in which both the top and bottom surfaces of the putter head include a port member 208*a* with direct access to the cavity 208. Either or both of these ports 208*a* may be used when filling the cavity 208 and the openings 206 with polymeric material (as will be described in more detail below in conjunction with FIG. 16).

Figure 8:
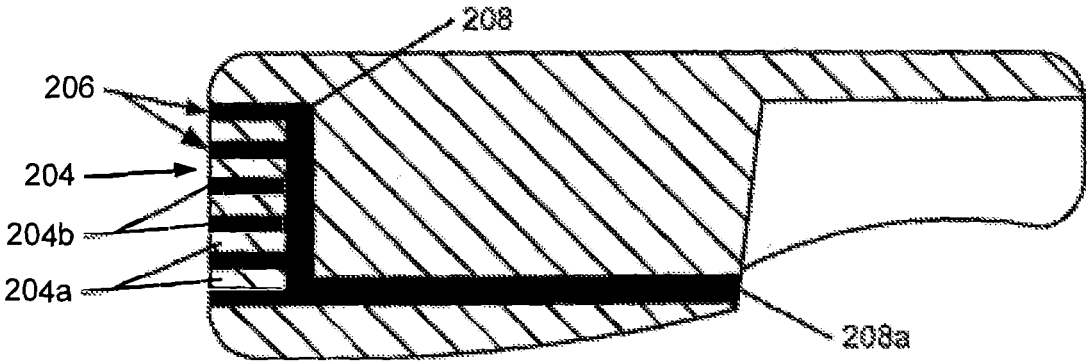

FIG. 8 illustrates yet another example port configuration for a putter structure that may be used in accordance with at least some examples of this invention. As shown in FIG. 8, in this putter head structure the port 208*a* is provided in a rear face surface of the putter structure. Such a port 208*a* location may be desirable, for example, when the putter body is made of a relatively heavy material (such as a relatively heavy metal material) and/or removal of a relatively large amount of this material is desired to lighten the overall putter head structure (i.e., the larger distance between the cavity 208 and the port 208*a* will require the removal of a larger amount of metal material to place the port 208*a* in direct fluid communication with the cavity 208. Of course, more than one port 208*a* may be provided on the rear surface (or on another surface) of the putter structure, if desired. The port 208*a* may have the same dimensions as a cross section of the cavity 208 to which it leads (e.g., the same width and height, the same diameter, the same shape, etc.) or these dimensions or shapes may be different from one another.

Figure 9:
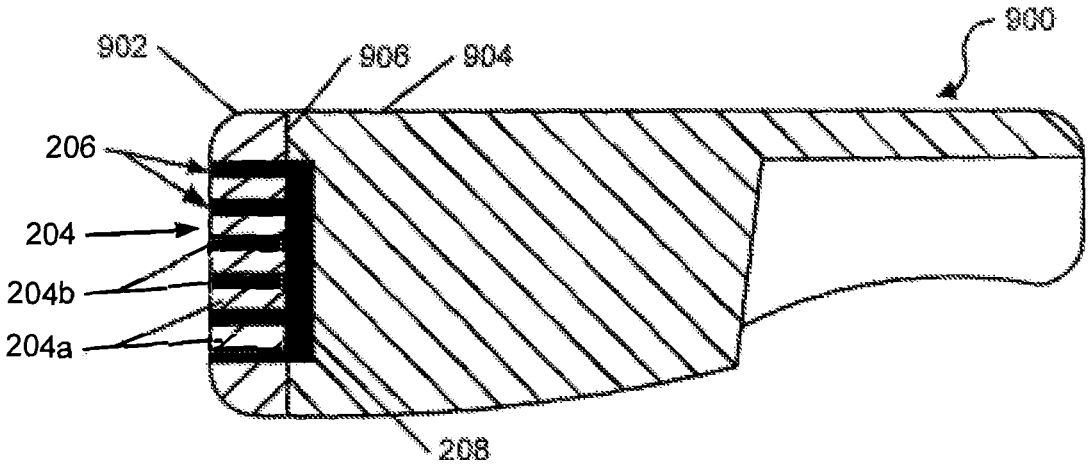

While all of the above examples illustrated a putter structure with one main body part and the polymeric material inserted therein, the invention is not limited to this configuration. Rather, the putter main body may be constructed from multiple parts without departing from this invention. FIG. 9 illustrates an example putter head structure 900 in which the putter head includes a ball striking face portion 902 that is engaged with a main body portion 904. Any desired manner of engaging the ball striking face portion 902 with the main body portion 904 may be used without departing from this invention. For example, these portions 902 and 904 may be engaged by mechanical connectors (e.g., threaded connectors, rivets, etc.), by fusing techniques (e.g., welding, brazing, soldering, etc.), by cements or adhesives, by combinations of these manners, and/or in other manners. Other numbers and combinations of parts may be provided in the overall putter head structure without departing from this invention.

FIG. 9 illustrates additional potential features of putter heads in accordance with this invention. In this example structure 900, no external port 208*a* with access to cavity 208 is present. Rather, in this example structure 900, the cavity 208 is defined in a surface 906 of the main body portion 904 to which the striking face portion 902 is connected (the striking face portion 902 includes the openings 206 defined therein). The openings 206 and cavity 208 may be filled with polymeric material through one or more of the openings 206 located on the ball striking face 204. As additional alternatives, if desired, the cavity 208 may be defined in the rear surface of the striking face portion 902, or the cavity 208 may be partially defined in each of the portions 902 and 904. As yet an additional potential alternative, if desired, the cavity 208 may be omitted (and the various openings 206 may be separately filled with the polymeric material). A single putter head structure also may include any combination of these features, without departing from this invention.

Figure 10:
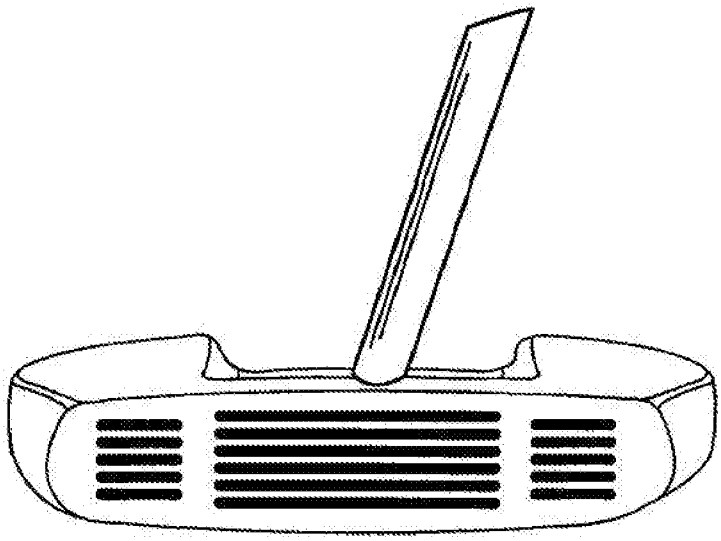
FIGS. 10 through 12B illustrate various examples of the openings and the polymeric material arrangements on the ball striking surface of a putter structure in accordance with this invention.

The openings on the ball striking face through which the polymeric material is exposed also may have a wide variety of configurations without departing from this invention. FIGS. 1A and 2A illustrate the openings (and thus the exposed polymeric material) as a plurality of elongated, continuous slots that extend across the majority of the ball striking face. This is not a requirement. For example, as illustrated in FIG. 10, the ball striking face may include multiple sets of separated openings filled with polymeric material. These sets of openings may align with one another or may be offset from one another as one moves across the ball striking face. The sets of openings may extend to a common cavity in the body member, to different cavities, or to no common cavity at all, if desired. While not illustrated in FIG. 10, if desired, the exposed surfaces of the sets of separated openings may be oriented at different angles from one another and/or may extend rearward at different angles from one another. As yet another example, if desired, the openings within a set need not be parallel to one another.

Figure 11:
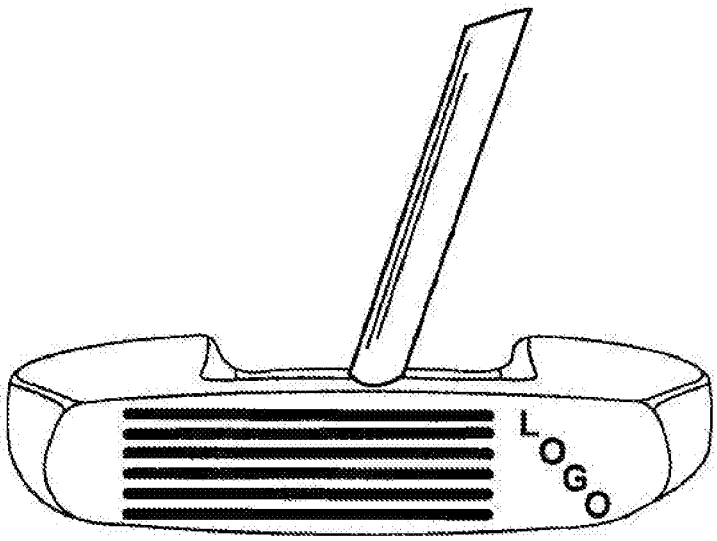

The openings (and thus the exposed polymeric material on the ball striking surface) are not limited to narrow, elongated slots, as illustrated in the previous examples. Rather, if desired, all or some portion of the openings may be of a different shape, e.g., to produce a stylized design, pattern, alphanumeric information, or other information on the ball striking face, such as a logo, manufacturer name, brand name, or trademark information, as illustrated in FIG. 11. This feature also may be used to customize the putter head, e.g., to include a personal name (such as the putter owner's name), a team name, or any other desired information, or to provide an end user (such as the club purchaser or other person) with the ability to design his or her own putter face.

Figure 12A:
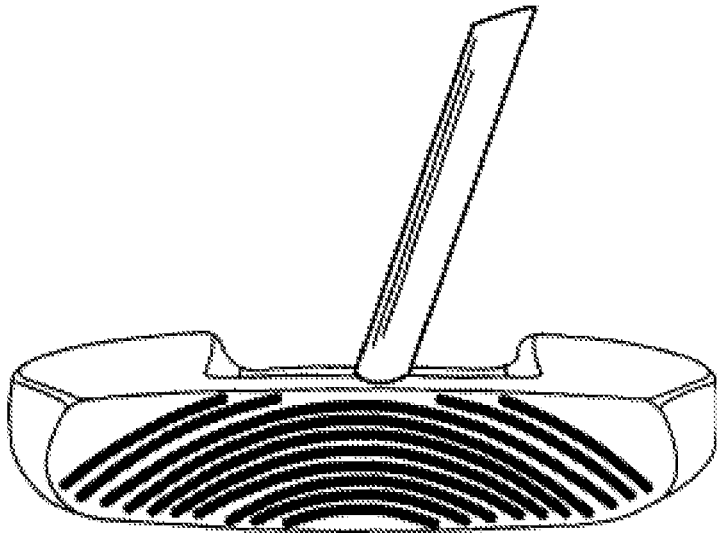

FIG. 12A illustrates yet another pattern of openings (and thus another pattern of exposed polymeric material on the ball striking face surface). In this example construction, the ball striking face includes the openings and the polymeric material arranged in an arched or curved pattern across the ball striking surface. In this structure (as well as the other opening/exposed polymeric material structures described above), grooves or scorelines may be included in the polymeric material, in the material between the polymeric material, or both, e.g., as described above in conjunction with FIGS. 2C, 2D, 3, and 4.

Figure 12B:
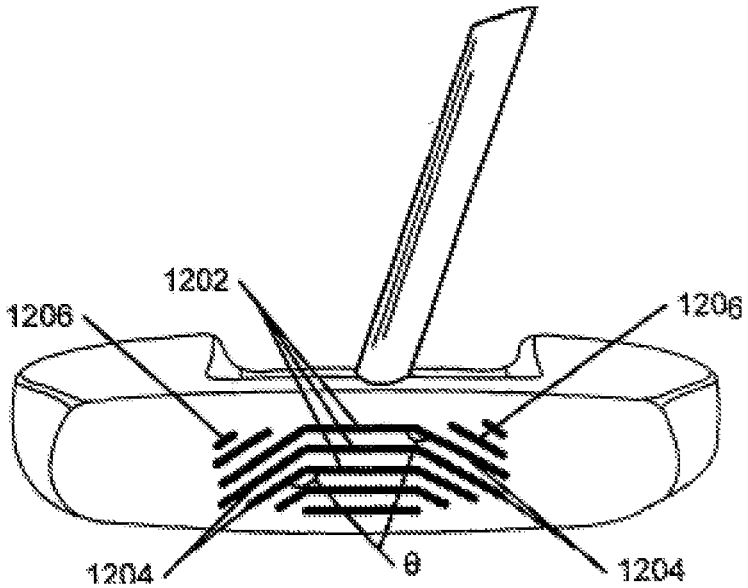

FIG. 12B illustrates another pattern of openings (and thus another pattern of exposed polymeric material on the ball striking face surface). In this example construction, the ball striking face includes the openings and the polymeric material arranged in linear segments across the ball striking surface. In the center of the putter face, a series of generally horizontal linear segments 1202 are provided (when the putter is oriented in a ball address position, as shown in FIG. 12B), and on at least some of these horizontal segments 1202, slanted, linear, downwardly extending end segments 1204 are provided that extend contiguously with the horizontal segments 1202. Any desired angle θ between the slanted, linear end segments 1204 and the horizontal segments 1202 may be provided without departing from this invention. In some more specific examples, θ may be in the range of 10-80°, and in some structures, between 20-70° or even between 30-60°, and the various angles θ within a single putter head may be the same or different without departing from this invention. In addition, if desired, one or more individual slanted segments 1206 may be provided independent of horizontal segments, e.g., at the upper edges of the overall polymeric segment design (running parallel to or substantially parallel to slanted segments 1204 associated with a horizontal segment). As other alternatives, if desired, the slanted segments 1204 and/or 1206 may be parallel or non-parallel, may extend upward or downward, may differ in number from those illustrated, may be discontinuous (spaced apart somewhat) from their associated horizontal segment 1202 (if any), may all extend downward to a common base line of the putter structure (e.g., to a common horizontal line), may all extend downward to different horizontal locations, etc. In this illustrated structure (as well as the other opening/exposed polymeric material structures described above), grooves or scorelines may be included in the polymeric material, in the material between the polymeric material, or both, e.g., as described above in conjunction with FIGS. 2C, 2D, 3, and 4. The slanted segments 1204 and/or 1206 (as well as any grooving or scorelines associated therewith), may help keep the ball on the desired line when hit off-center from the putter face.

The overall pattern of exposed polymeric material at the putter face may extend and span any desired amount across the putter face in the heel-to-toe direction, such as from 25-100% of the face's heel-to-toe direction, from 30-90% of the face's heel-to-toe direction, or even from 40-80% of the face's heel-to-toe direction. In some example structures in accordance with this invention, the overall pattern of exposed polymeric material at the putter face may extend across at least the central 25% of the face in the heel-to-toe direction, and in some examples, the polymeric material will extend across at least the central 40% of the face or across at least the central 50% of the face in the heel-to-toe direction.

Figure 13:
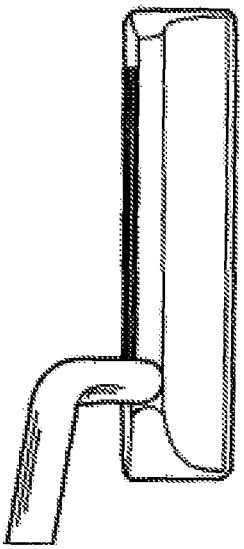
FIGS. 13 through 15 illustrate various example putter head constructions that may include polymer filled openings on the ball striking face and cavities in accordance with examples of this invention.
Figure 14:
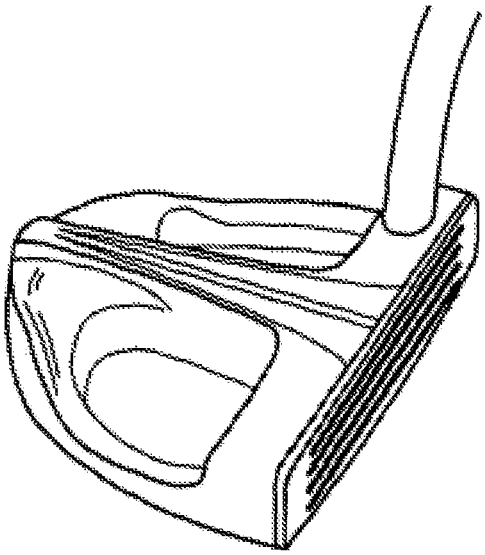

Aspects of this invention may be practiced with any desired putter head construction without departing from this invention. FIGS. 1A through 12B illustrate aspects of the invention included in various mallet type golf putter head structures. As illustrated in FIG. 13, aspects of this invention also may be practiced with blade type putter heads. FIG. 14 illustrates aspects of this invention practiced in a high moment of inertia, large size putter head construction.

Figure 15:
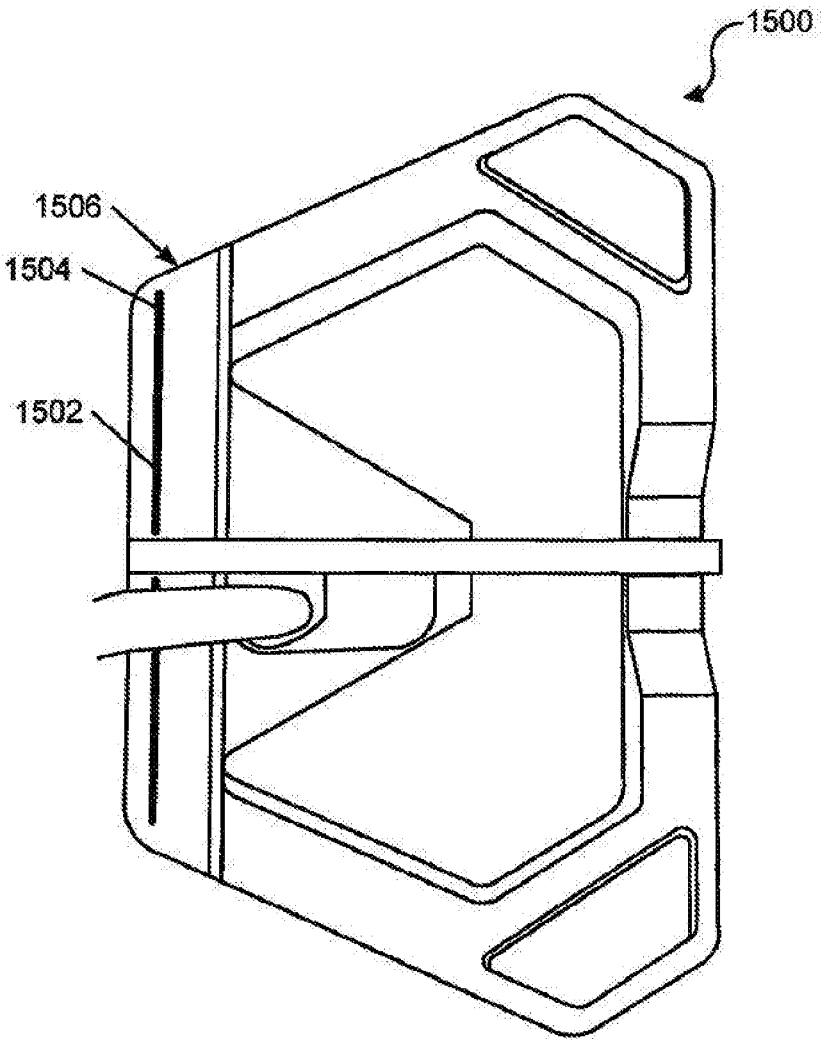

FIG. 15 illustrates aspects of this invention practiced in yet another putter head construction 1500. In this example structure 1500, the port providing access to the cavity defined in the putter body is provided in the top surface 1504 of the putter head's ball striking face 1506. In this structure 1500, the exposed polymeric material 1502 at the top surface 1504 of the putter head 1500 forms a portion of the alignment aid for the putter head 1500. This exposed top surface 1504 port may extend any desired distance along the top of the putter head, e.g., from 25-100% of the overall heel-to-toe width of the putter head at the location of the port, and in some examples, from 50-95% and even from 50-85% of the overall heel-to-toe width at the location of the port. As noted above, however, rather than directly exposing polymeric material 1502, the port may be closed by a cover member to prevent direct exposure of the polymeric material 1502. The exposed polymeric material and/or the cover member may be made of any desired color without departing from this invention.

The invention is not limited to use in the various putter constructions shown. Rather, aspects of this invention may be used in the construction of any desired putter construction, including general putter constructions and styles that are known and used in the art.

Figure 16:
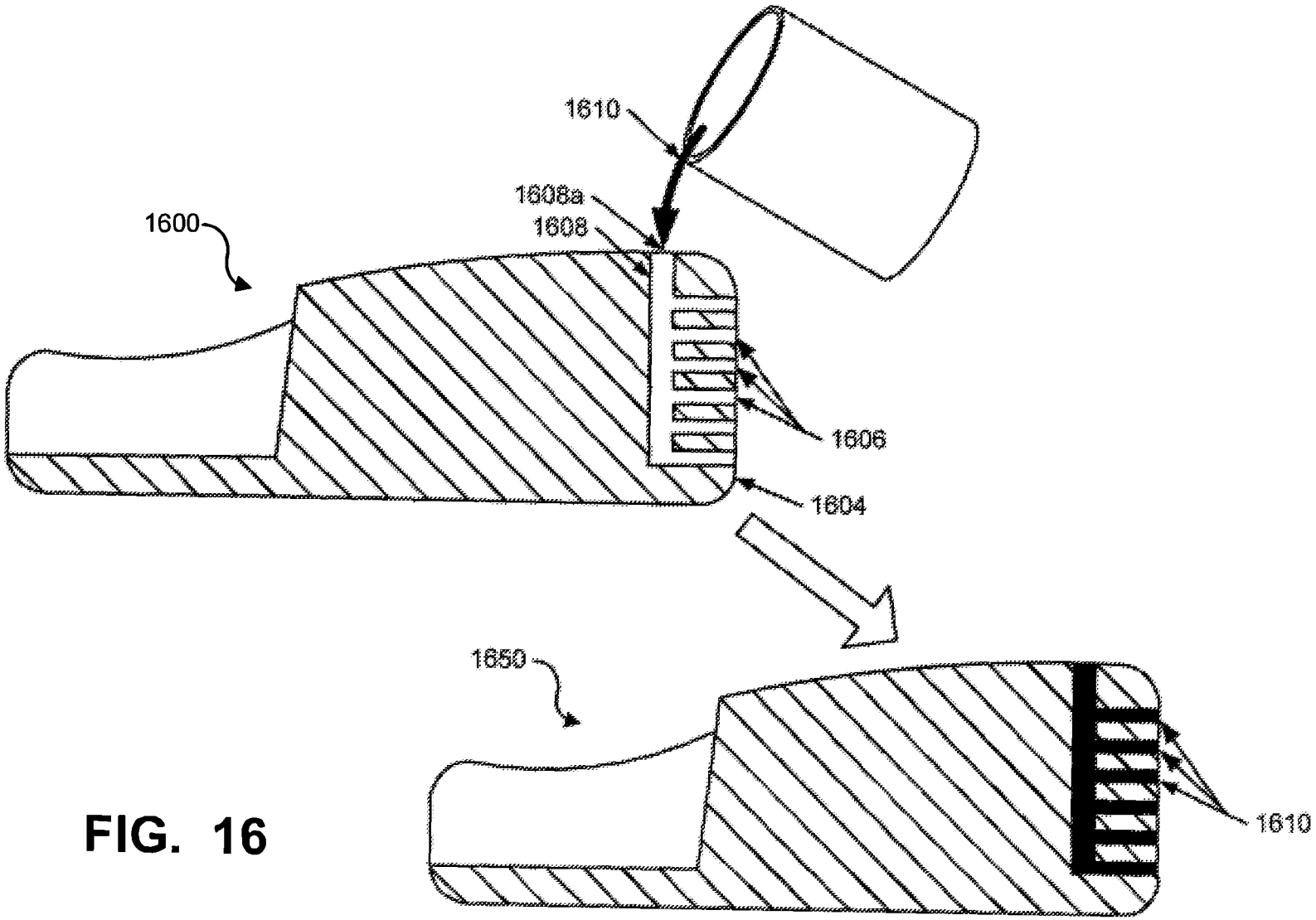
FIG. 16 provides an illustrative aid for explaining various example methods of making putter heads in accordance with this invention.

FIG. 16 generally illustrates a manner of making a putter head construction in accordance with examples of this invention. The method begins with a general putter body 1600 (or a putter ball striking face member) into which a cavity 1608 has been provided and into which a plurality of openings 1606 have been provided in the ball striking surface 1604. The cavity 1608 and the openings 1606 may be provided in the putter body structure 1600 in any desired manner without departing from the invention, such as by machining them in, by molding or casting them in, by forging, etc. Liquid polymer material (or a precursor thereof) 1610 is introduced into the cavity 1608 via port 1608*a*. The liquid polymer material 1610 flows from the cavity 1608 to fill the openings 1606 and the channels extending rearward therefrom. If desired, prior to introducing the polymer material 1610, the putter body 1600 (or at least some portions thereof) may be fit into a mold or other suitable structure to hold the liquid polymer in place. The polymeric material 1610 may be introduced by pouring, by injection molding processes (e.g., under pressure), or the like. Once introduced, if necessary, the polymeric material 1610 may be exposed to conditions that enable it to harden, such as to cool temperatures; to high temperatures; to pressure; to ultraviolet, infrared, or other radiation; etc. The final putter body 1650 (including the cured polymeric material 1610 therein), may be further processed in any desired manner, e.g., by painting, anodizing, or other finishing processing; by cutting scorelines or grooves into the face of the putter head (e.g., as described above); by adding a shaft and/or grip member to the club head; etc.

Any desired polymeric material may be used without departing from this invention, including thermoplastic or thermosetting polymeric materials, synthetic rubber type polymeric materials, etc., such as polyurethanes, vinyls (e.g., ethylvinylacetates, etc.), nylons, polyethers, polybutylene terephthalates, etc.

Putters and putter heads may have any desired constructions, materials, dimensions, loft angles, lie angles, colors, designs, and the like without departing from this invention, including conventional constructions, materials, dimensions, loft angles, lie angles, colors, designs, and the like, as are known and used in the art.

CONCLUSION

Of course, many modifications to the putter and putter head structures and/or methods for making these structures may be used without departing from the invention. For example, with respect to the structures, grips, aiming indicia or markings, other indicia or markings, different types of putter heads, various shaft curvatures and/or shapes, various shaft connecting member shapes, and/or other structural elements may be provided and/or modified in the structure without departing from the invention. With respect to the methods, additional production steps may be added, various described steps may be omitted, the steps may be changed and/or changed in order, and the like, without departing from the invention. Therefore, while the invention has been described with respect to specific examples including presently preferred modes of carrying out the invention, those skilled in the art will appreciate that there are numerous variations and permutations of the above described structures and methods. Thus, the spirit and scope of the invention should be construed broadly as set forth in the appended claims.

We claim:

1. A golf club head comprising:

a body having:

a ball striking face, a cavity defined in the body at a location behind the ball striking face, a first cavity opening at a surface of the body other than the ball striking face, wherein the first cavity opening opens into the cavity, and a plurality of ball striking face openings intersecting the cavity and extending in a direction away from the cavity, wherein the plurality of ball striking face openings are separate from the first cavity opening; and a polymeric material provided in the cavity, wherein the plurality of ball striking face openings extend to and open at the ball striking face, wherein the plurality of ball striking face openings extend in an arched or curved pattern across the ball striking face in a range of 10%-80% of a heel-to-toe length dimension of the ball striking face, wherein adjacent ball striking face openings are separated by a separation distance, wherein the separation distance corresponds to the dimensions of the ball striking face member material between adjacent ball striking face openings, and wherein the ball striking face member material between adjacent ball striking face openings is metallic, wherein the separation distance between any two adjacent ball striking face openings varies along the length of any two adjacent ball striking face openings, wherein the polymeric material extends to the ball striking face and at least partially fills the ball striking face openings.

2. The golf club head according to claim 1, wherein the ball striking face further comprises an exposed ball striking surface, and wherein the exposed ball striking surface further includes a plurality of grooves.

3. The golf club head according to claim 2, wherein the plurality of grooves each extend in an arched or curved pattern across the ball striking face.

4. The golf club head according to claim 3, wherein each of the plurality of grooves has a top edge and a bottom edge, and wherein the top edge is defined by the metallic ball striking face member material between adjacent ball striking face openings, and the bottom edge is defined by the polymeric material at least partially filling the ball striking face openings.

5. The golf club head according to claim 3, wherein each of the plurality of grooves has a top edge and a bottom edge, and wherein the top edge and the bottom edge are defined by the polymeric material at least partially filling the ball striking face openings.

6. The golf club head according to claim 3, wherein each of the plurality of grooves has a top edge and a bottom edge, and wherein the bottom edge is defined by the metallic ball striking face member material between adjacent ball striking face openings, and the top edge is defined by the polymeric material at least partially filling the ball striking face openings.

7. The golf club head according to claim 3, wherein each of the plurality of grooves has a top edge and a bottom edge, and wherein the top edge and the bottom edge are defined by the metallic ball striking face member material between adjacent ball striking face openings.

8. The golf club head according to claim 1, wherein the opening extends in an arched or curved pattern in a range of 15%-85% of a heel-to-toe length dimension of the body at a location of the opening.

9. The golf club head according to claim 1, wherein the opening extends in an arched or curved pattern in a range of 25%-75% of a heel-to-toe length dimension of the body at a location of the opening.

10. The golf club head according to claim 1, wherein the opening is provided at a bottom surface of the body.

11. The golf club head according to claim 10, wherein the body defines an external surface remote from the bottom surface, the external surface having a second opening, the second opening communicating with the cavity, and wherein the polymeric member is exposed at the second opening.

12. The golf club head according to claim 11, wherein the external surface is a top surface of the body.

13. The golf club head according to claim 1, wherein the opening is provided at a top surface of the body.

14. The golf club head according to claim 13, wherein the polymeric material is exposed at the top surface of the body.

15. The golf club head according to claim 1, wherein the cavity has a closed end located within the body.

16. The golf club head according to claim 1, wherein the cavity extends into the body in a top-to-bottom direction for a height ranging from 50-95% of an overall putter head height at a location of the cavity.

17. The golf club head according to claim 1, wherein an interior wall of the cavity is generally parallel to the ball striking face.

18. The golf club head according to claim 1, wherein the cavity has a width and the opening has a width that generally coincides with the width of the cavity.

19. The golf club head according to claim 1, wherein the polymeric member is one of a thermoplastic polymeric material, a thermosetting polymeric material, a polyurethane material, a vinyl material, a nylon material, a polyether material and a polybutylene terephthalate material.

20. The golf club head according to claim 1, wherein the opening is generally in alignment with the cavity.

* * * * *